US005306103A

United States Patent [19]

Spencer

[11] Patent Number: 5,306,103

[45] Date of Patent: Apr. 26, 1994

[54] WHEELED CARRIAGE ASSEMBLY FOR TRENCH SHIELDS

[76] Inventor: Dennis I. Spencer, 12140 E. 116th Cir., Henderson, Colo. 80640

[21] Appl. No.: 82,616

[22] Filed: Jun. 25, 1993

Related U.S. Application Data

[63] Continuation-in-part of Ser. No. 30,788, Mar. 12, 1993.

[51] Int. Cl.[5] ..... E02D 19/00

[52] U.S. Cl. ..... 405/282; 405/283

[58] Field of Search ..... 405/282, 283, 272, 273

[56] References Cited

U.S. PATENT DOCUMENTS

| | | | |
|---|---|---|---|
| 2,987,891 | 6/1961 | Phillips | 405/283 |
| 3,362,168 | 1/1968 | Dotlich | 405/283 |
| 3,541,799 | 11/1970 | Jost et al. | 405/283 |
| 3,788,086 | 1/1974 | West | 405/283 |
| 4,002,035 | 1/1977 | Wright | 405/283 |
| 4,193,717 | 3/1980 | Treacy | 405/283 |

*Primary Examiner*—Dennis L. Taylor

*Attorney, Agent, or Firm*—Timothy J. Martin; Carl Schaukowitch

[57] ABSTRACT

A carriage assembly for suspending and supporting trench shields in an excavated trench has an axle member that spans the trench, a wheel assembly on each end of the axle member, a pair of bracket elements on the axle member and a support member depending from each bracket element for connection to a trench shield. The wheel assemblies have wheels that rotate with respect to the bracket elements and engage the surface of the ground laterally adjacent the trench. Adjustments are provided to selectively vary the spacing of the wheels and the bracket elements.

22 Claims, 4 Drawing Sheets

WHEELED CARRIAGE ASSEMBLY FOR TRENCH SHIELDS

RELATED APPLICATION

The present invention is a continuation-in-part of my invention entitled Protective Structure For Excavations, Ser. No. 08/030,788, filed Mar. 12, 1993.

FIELD OF INVENTION

The present invention generally relates to protective structures adapted to be used in excavations, specifically trenches, in order to buttress or otherwise protect against collapse of the sidewalls thereof. More particularly, however, the present invention is directed to auxiliary equipment used in conjunction with such trench shields and specifically to a wheeled carriage assembly which may suspend and support a trench shield for advancement along an excavated trench while oriented therein.

BACKGROUND OF THE INVENTION

As noted in my above referenced patent application, the construction industry often desires to employ excavations of various types, such as foundations, trenches and the like. Where excavations are made in the earth, it is desirable to support the upright sidewalls of the excavation against collapse or to protect a sheltered workspace in the event of collapse. This is important not only from a cost standpoint, but also from the potential danger of injury or death to workers who are situated within the excavation. This is especially true in trenches which are excavated, for example, to lay conduit, pipe, communication lines and the like.

Various construction projects require that an elongated, narrow trench be excavated in the ground. By way of one example, where pipelines are being constructed, sections of pipe, for example, are laid in the bottom of the trench so that workers are required to descend into the trench to connect the pipe sections to each other or to otherwise install associated equipment. As sections of the pipeline are completed, the trench is filled-in behind the workers and more earth is excavated to extend the trench in front of the workers.

Naturally, should the sidewalls of a trench collapse, workers are exposed to great danger of bodily injury and even death. Therefore, it is desirable to protect against the collapse of the sidewalls of the trench, and some governmental agencies have even promulgated regulations directed to such structures, commonly referred to as "trench shields". Prior to the trench shield disclosed in my above referenced application, pre-existing trench shields had a relatively low strength-to-weight ratio. Thus, existing trench shields were unwieldly to insert and remove from the trench or to otherwise advance along the trench as worked progressed. The need to continually move a trench shield to provide a protected space for the workers also poses some danger of injury to the workers who may be struck by the trench shield during advancement or otherwise injured by the construction equipment necessarily employed to lift and to reposition the trench shield. Even with the improved strength-to-weight ratio of my trench shield disclosed in my above referenced application, repositioning of a trench shield can be cumbersome and time consuming. However in that application, I disclosed an auxiliary carriage assembly adapted to be employed with my trench shield. The present invention is thus directed to that carriage assembly as well as modifications thereto to be used with other types of trench shields as known in the art.

SUMMARY OF THE INVENTION

It is an object of the present invention to provide a new and useful carriage assembly adapted for use with trench shields in order to advance a trench shield along a trench while positioned therein.

A further object of the present invention is to provide a carriage assembly which suspends a trench shield in a trench and allows advancement of the trench shield without the need to remove the trench shield from the trench.

Yet another object of the present invention is to provide a carriage assembly which allows repositioning of a trench shield within a trench without resort to the aid of heavy construction equipment.

Still a further object of the present invention is to provide a carriage assembly for trench shields which is adjustable to accommodate shield widths corresponding to different trench widths.

Another object of the present invention is to provide a carriage assembly that suspends a trench shield within a trench and which is adjustable to accommodate different widths of excavated trenches.

It is a further object of the present invention to provide a carriage assembly for trench shields that is relatively simple and inexpensive in construction yet strong and durable for heavy industrial use.

Accordingly to the present invention, a carriage assembly is provided for purposes of supporting a trench shield in a suspended relationship in a trench excavated in the ground. Usually, two such carriage assemblies are used and are connected to opposite ends of a trench shield so that the trench shield may be advanced within the trench by rolling the carriage assemblies along the surface of the ground. Each such carriage assembly includes an axle member in which a pair of bracket elements are disposed. A pair of wheel assemblies are disposed at opposite ends of the axle member, and each wheel assembly includes a wheel that is rotatably mounted with respect to the bracket elements. Thus, the wheels operate to engage a surface of the ground laterally adjacent the trench with the axle members spanning the trench. A support member is attached to each of the bracket elements in downwardly depending relation and includes connecting elements for interconnecting to the trench shield whereby the trench shield may be fastened to the support members and thereby suspended from the axle member.

Preferably, the spacing between the bracket elements may be adjusted. To this end, each of the bracket elements may be slideably disposed on the axle member and may have locking elements associated with each bracket element to releasably secure the bracket elements at a selected location therealong. Alternatively, a spacing bar may extend between the support members in parallel relation to the axle member in order to space the bracket elements apart from one another. For example, the spacing bar is constructed as a pair of complementary telescoping spacing bar sections, and a locking element is provided to retain the complementary telescoping spacing bar sections at a selected effective length.

Although the wheels may be affixed to the axle member, in which case the bracket elements are each provided with at least one bearing for rotatably receiving the axle member, it is preferred that the wheels rotate with respect to the axle member. In addition, the wheel assemblies can be constructed to include a mounting member that adjustably interconnects a respective wheel to the axle member in a manner such that the wheels may be adjustably spaced apart from one another. For example, the axle member may be a tubular central axle section having opposite open ends operative to telescopically receive the mounting members, and axle locking elements are operative to retain the mounting members at a selective effective axle width.

As noted, the support members are operative to interconnect to a trench shield. Thus, complementary connections are provided on the trench shield and on the support members. For example, the support members can be elongated tubular pieces adapted to be telescopically received in complementary tubular sections of the trench shield and retained therein by means of retaining pins. Alternatively, the support member may be a channel piece adapted to be bolted onto the trench shield.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention is directed to a carriage assembly that is particularly adapted for use in supporting trench shields in suspended relation within a trench excavation so as to provide a protected space for workers while working on a construction or repair project within the trench. The carriage assembly, according to the embodiment of the present invention disclosed herein, broadly includes an axle member that is provided with a pair of wheels at opposite ends thereof for travel along a ground surface that is laterally adjacent the trench excavation, a pair of bracket elements that are disposed on the axle member and a support member attached to each of the bracket elements in downwardly depending relationship for attachment to a trench shield located within the trench excavation.

Figure 1:
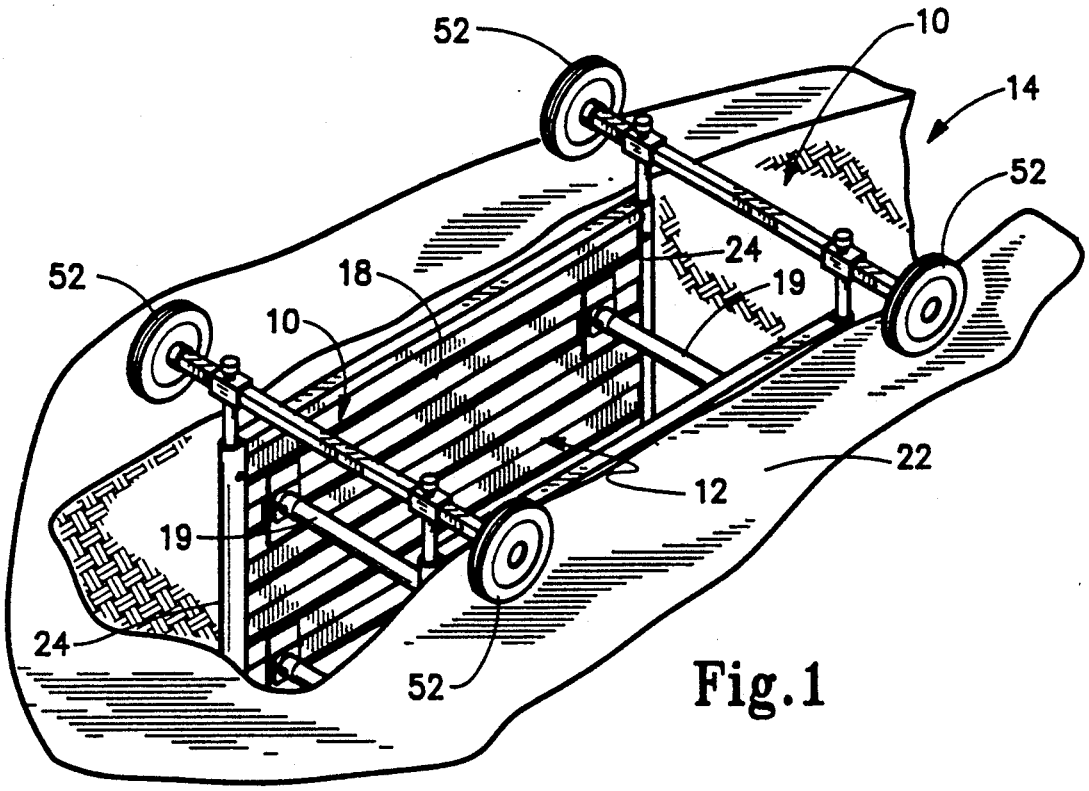
FIG. 1 is a perspective view of a pair of carriage assemblies according to a first exemplary embodiment of the present invention showing a trench shield in supported, suspended relation in a trench excavation.
Figure 2:
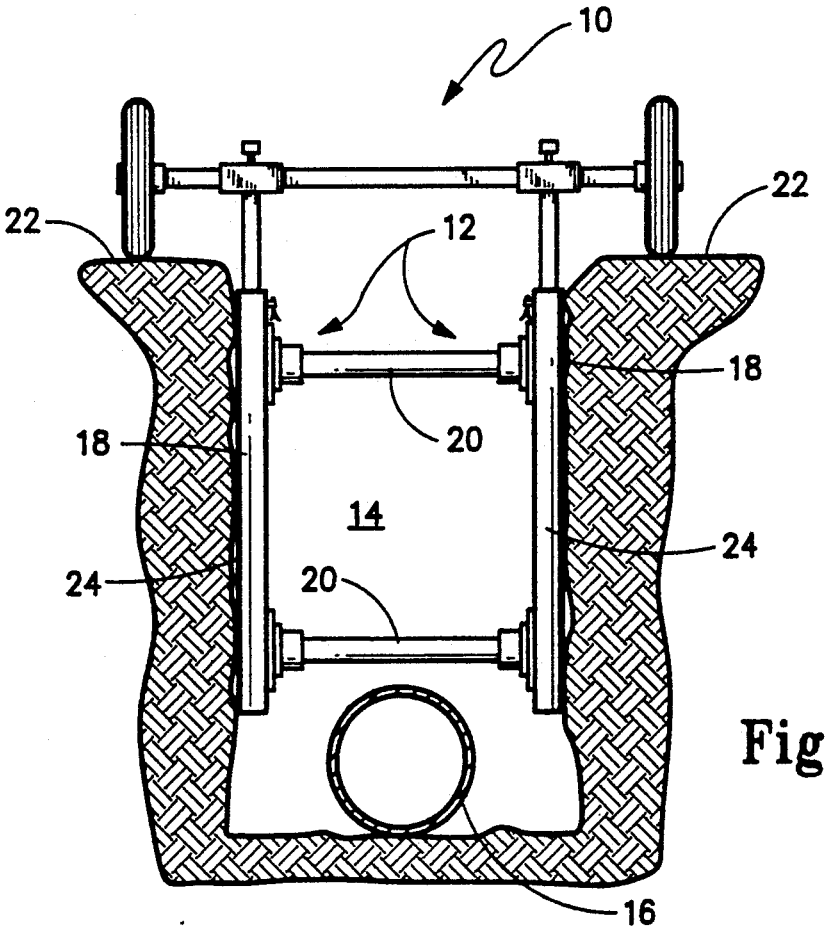
FIG. 2 is a end view in elevation showing the carriage assembly and trench shield of FIG. 1.

As is shown in FIGS. 1 and 2, therefore, a first exemplary embodiment of the present invention shows a pair of carriage assemblies 10 supporting a trench shield 12 and a trench excavation 14 that, for example, is excavated for the laying of a pipe 16. Trench shield 12 includes a pair of protective panels 18 such as that described with respect to my U.S. patent application Ser. No. 08/030,788, which are held and spaced apart relation by means of a pair of spreader beams 20.

Figure 3:
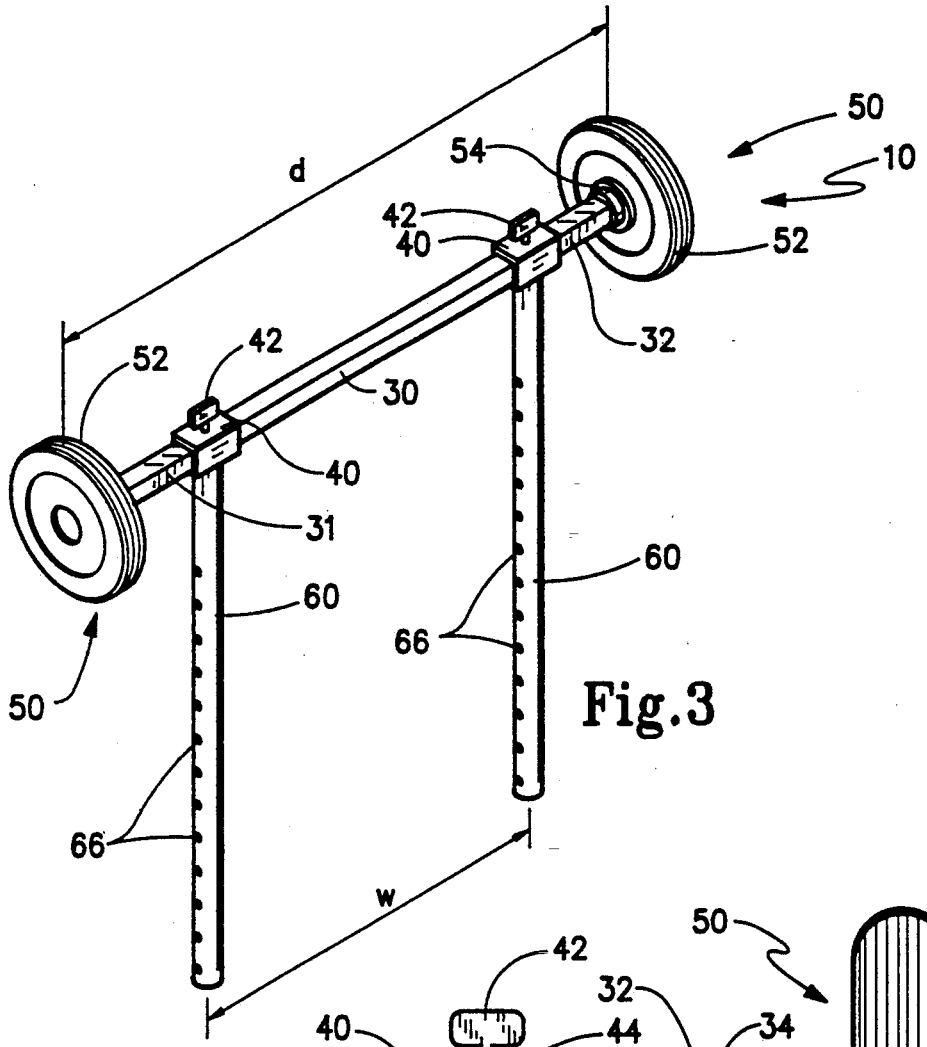
FIG. 3 is a perspective view of a single carriage assembly shown in FIG. 1.
Figure 4:
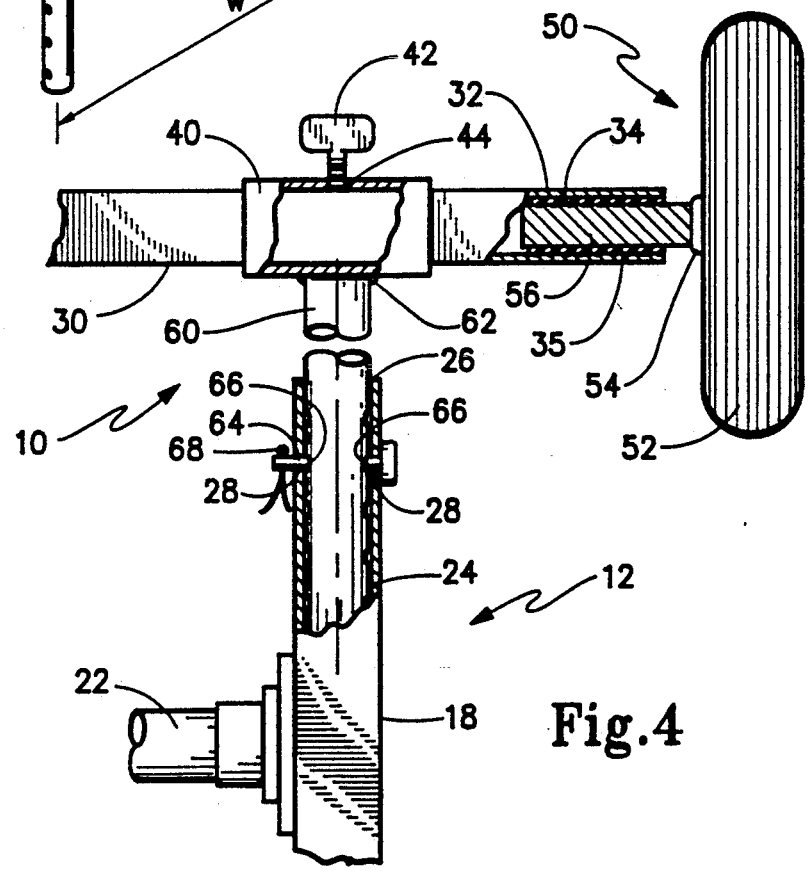
FIG. 4 is a side view, partially broken away and in partial cross-section, showing the carriage assembly of FIGS. 1–3 as secured to the trench shield of FIG. 1 and 2.

As is best shown in FIGS. 3 and 4, each carriage assembly 10 includes an axle member 30 having a pair of housings or bracket elements 40 mounted thereon. Wheel assemblies 50 are mounted at opposite ends, 31, 32 of axle member 30, and each wheel assembly 50 includes a wheel 52 rotatably mounted with respect bracket elements 40. A support member 60 is attached to each of bracket elements 40 in downwardly depending relation therefrom by means, for example, by weldments 62. As in shown in FIG. 3, wheels 52 are separated a distance "d" from one another so that, as may be seen in FIGS. 1 and 2, wheels 52 are operative to engage a surface 22 of the ground laterally adjacent to the trench excavation.

With reference again to FIGS. 3 and 4, it may be seen that axle member 30 is preferably formed as a tubular piece of metal, such as steel, that is square shaped in cross-section. Bracket elements 40 are, accordingly, square shaped sleeved housings that are slideably received on axle 30, and brackets 40 are likewise preferably formed of steel. Threaded thumb screws 42 ar provided in threaded bores 44 so that the distance "w" between the brackets 42 (and thus support members 60) may be adjustably varied. Thumb screws 42 form releasable locking elements to secure its associated bracket element 40 at a selected location along axle member 30.

Furthermore, as in seen in reference to FIGS. 3 and 4, wheel assemblies 50 each includes a bearing 54, which rotatably journals a wheel 52 on a respective cylindrical shaft 56. Shaft 56, in turn, is received in a bore 35 and a mounting block 34 that is affixed within the end, such as end 32, of axle 30. Thus, although shaft 56 is nonrotatable, wheels 52 may rotate on bearing 54 to allow advancement of trench shield within the trench excavation.

To this end, trench shield 12 is releasably secured to carriage assembly 10 by means of support members 60. As is shown in FIGS. 1, 2 and 4, and as described in my patent application, Ser. No. 08/030,788, each protective panel 18 has a rigidifying member 24 that has a circular passage way 26 formed axially thereof. Support members 60 are in the form of tubular pieces, preferably of steel, having a circular cross-section and sized for telescopic mated engagement with passageways 26 in rigidifying members 24. Each rigidifying member 24 has a pair of opposed openings 28 adapted to receive a retaining pin 64 therethrough. Each support member 60 has a plurality of pairs of opposed openings 66 sized and configured to align with openings 28 so that retaining pin 64 may be inserted transversely through the aligned openings 28 and 66. Retaining pin 64 is then held in position by means of clip 68. Thus it should be appreciated that the distance that protective panel 18 is suspended and supported by bracket elements 40 on axle 30 may be selectively adjusted by the selection of the pair of opening 66 used to mount rigidifying member 24 to support member 60.

In operation, as can be best seen in FIGS. 1 and 2, trench shield 12 is set to have a desired spacing between protective panels 18, which spacing is slightly narrower than the width of the trench excavation 14. A pair of carriage assemblies 10 are then mounted on the opposite ends of trench shield 12 by telescopically inserting supported members 60 in the respective rigidifying members 24. To this end, bracket elements 40 are loosened to allow adjustment of axle member 30. Axle member 30 is then centered with end bracket elements 40 and thumb screws 42 are tightened to lock bracket elements 40 and axle members 30 in the desired position. Next, trench shield 12 with carriage assemblies 1 attached thereto is lowered into trench 14 so that wheels 52 engage a surface of the ground laterally adjacent the trench. Trench shield 12 may now be advanced within excavation 14 without the need to remove it therefrom. This allows the trench to be extended b excavation and filled in behind completed work without the need to remove and replace trench shield 12.

Figure 5:
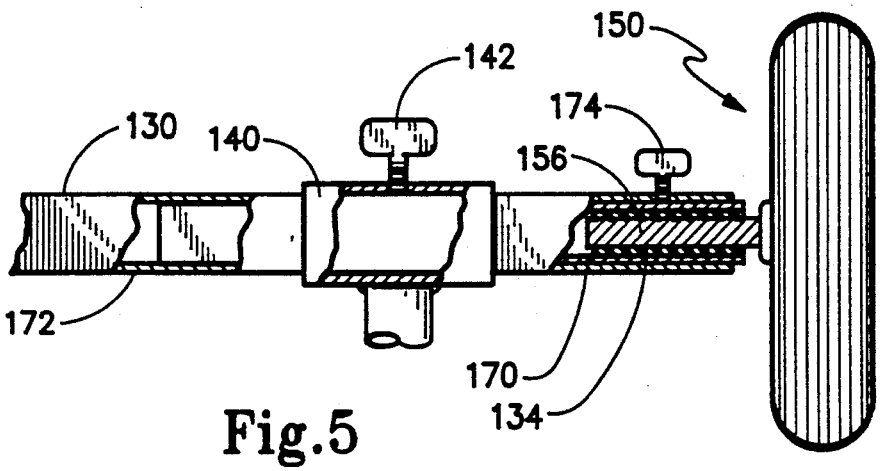
FIG. 5 is a side view, partially broken away and in partial cross-section showing a modified carriage assembly according to a second embodiment of the present invention.

The carriage assembly 10 described above has an axle 30 of defined length so that wheels 52 are spaced a distance "d" apart, as noted above. However, the distance "d" may be adjusted by providing slightly modified structure to wheel assemblies 50, as shown in FIG. 5. Here, wheel assembly 150 has a shaft 156 that is affixed in a mounting block 134 that, in turn, is affixed to a mounting member 170. Mounting member 170 is telescopically received in a tubular central axle section 172. To this end, tubular central axle section 172 is square-shaped in cross-section with mounting member 170 likewise being square shaped and cross-section but slightly smaller in configuration then the size of the central axle section 172. Thus, the distance "d" may be adjusted by loosening a set screw 174 and telescopically adjusting each of mounting members 170 with respect tubular central axle section 172. Once adjusted, each set screw 174 is tightened to retain the mounting members 170 at a selected extension with respect with central axle section 172. Bracket element 140 is then identical with bracket element 40 and is adjusted by means of thumb screw 142.

Figure 6:
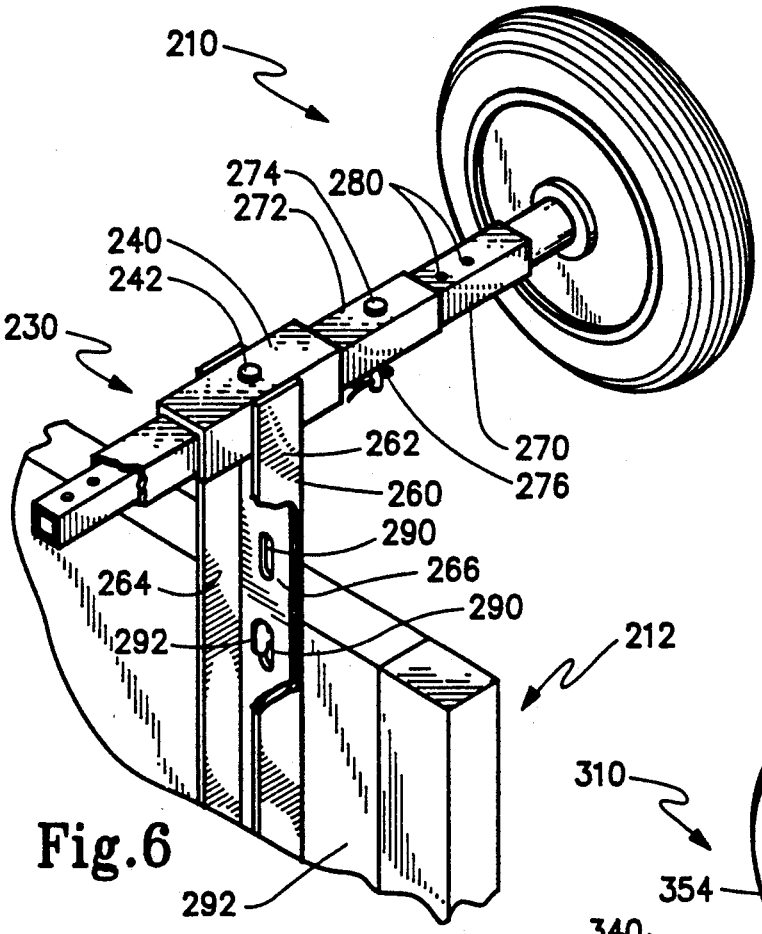
FIG. 6 is a perspective view, partially broken away, showing a third exemplary embodiment of the carriage assembly of the present invention attached to a trench shield of a type different from that shown in FIGS. 1 and 2.

It is possible to construct the carriage assembly according to the present invention in a variety of different matters, as would be apparent to the ordinarily skilled person in this field of invention based on the teachings of this disclosure. Likewise, it is possible to construct the carriage assembly so that it can be used with trench shields of a type different from that described with respect to trench shield 12. One such example of each of these modifications is shown in FIG. 6. Here, carriage assembly 210 includes an axle member 230 that includes a tubular central axle section 272 that is square shaped and cross-section. A pair of square shaped tubular mounting members, such as mounting member 270, are received in the opposite ends of central section 272 and adjust in a manner similar to that described with respect to FIG. 5. Here, however, central section 272 is provided with opposed holes which receive a retaining pin 274 therethrough and mounting members 270 are provided with pairs of aligned holes, such as holes 280, which register with the holes that receive pin 274. Pin 274 is then retained by means clip 276 which passes through the aligned holes 280. Bracket element 240 is again adjustable along central section 272 and may be locked in position by means of a set screw 242 that replaced thumb screws 42, 142, described above.

Furthermore, with respect to the embodiment of FIG. 6, it may be seen that support member 260 is in the form of a channel piece that has sides 262 and 264 secured, such as by welding, to bracket to element 240. Support member 260 has a bottom web 266 that is provided with a plurality of spaced slots 290 adapted to received bolts 292 to releasably secure support members 260 each of support members 260 to a trench shield 212 as specifically to a perfective panel 218 thereof. Here, support members 260 are directly connected to the side walls of panels 218, as is shown in FIG. 6.

Figure 7:
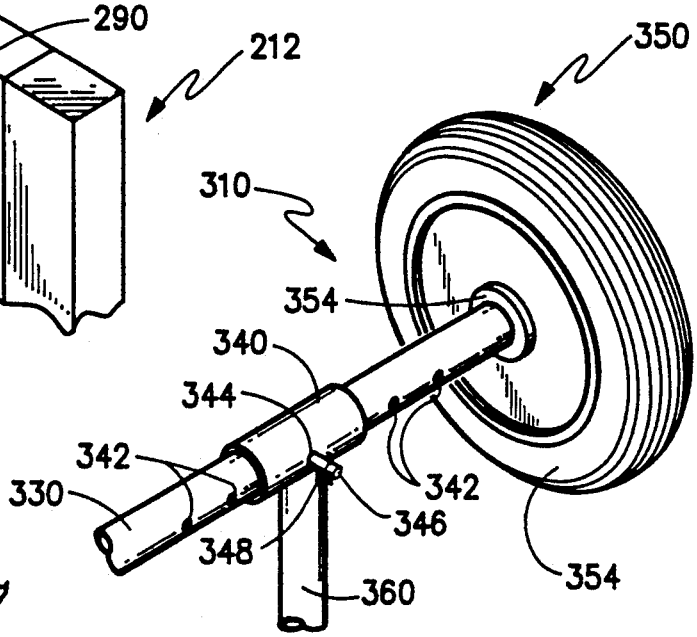
FIG. 7 is a perspective view of a fourth exemplary embodiment of the present invention.

A fourth embodiment of the present invention is shown in FIG. 7. Here it may be seen that axle member 330 of carriage assembly 310 may be a tubular member that is circular in cross-section. Wheel assembly 350 includes a wheel 352 that is mounted for rotation on a bearing 354 which is mounted to a shaft (not shown) that is affixed with respect to axle member 330. Bracket element 340 is in the form of a tubular sleeve that is slideably received upon axle member 330 with support member 360 depending downwardly therefrom. Axle member 330 is provided with a plurality of aligned holes 342 while bracket element 340 includes a pair of opposed holes 344 so that a retaining pin 346 may be inserted through hole 344 and an aligned pair of holes 342 to retain bracket 340 in a selected relation on axle member 330. Pin 346 is then held in the received position by means of clip 348. Thus, it may be seen that there are different structures for allowing relative adjustment of the bracket elements on the axle member and to allow for a different geometric configuration of the axle member and bracket elements. Again, however, it is preferred that all parts, with the exception of the wheel assemblies be constructed of a tubular steel.

Figure 8:
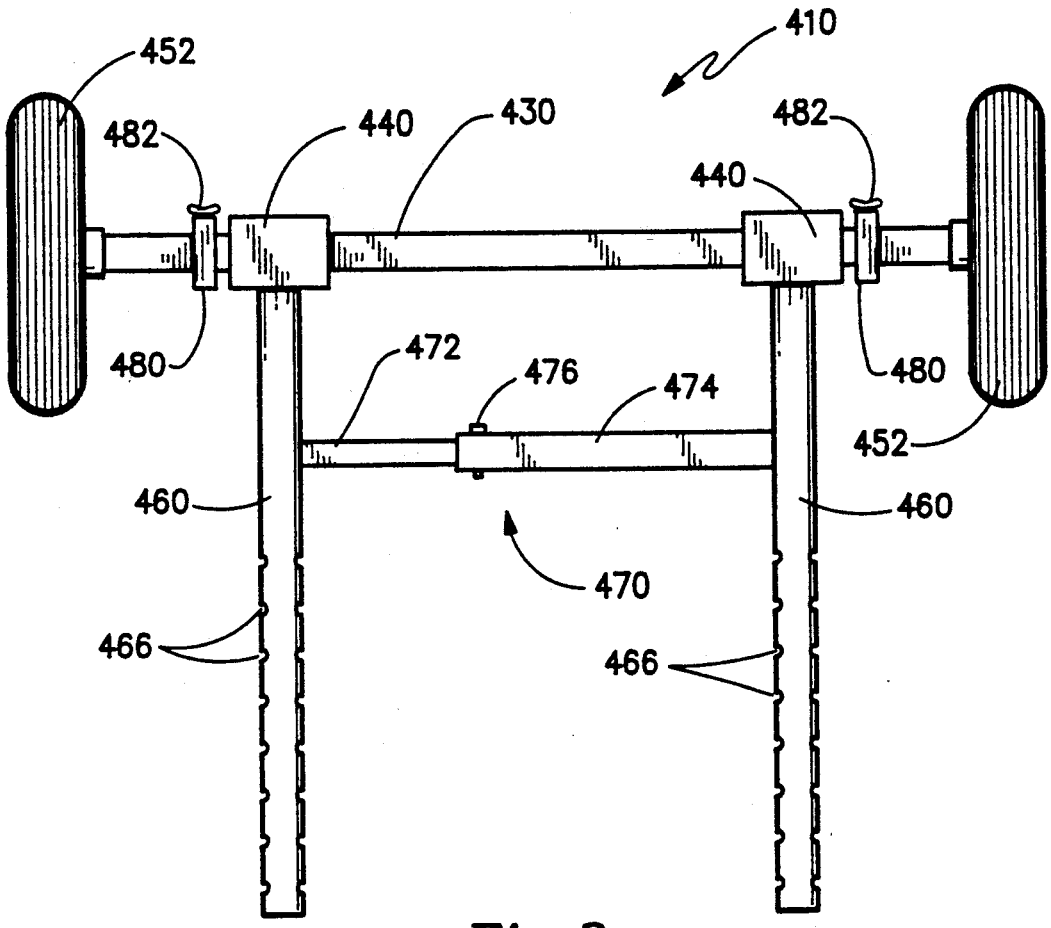
FIG. 8 is a side view of a fifth exemplary embodiment of the present invention.
Figure 9:
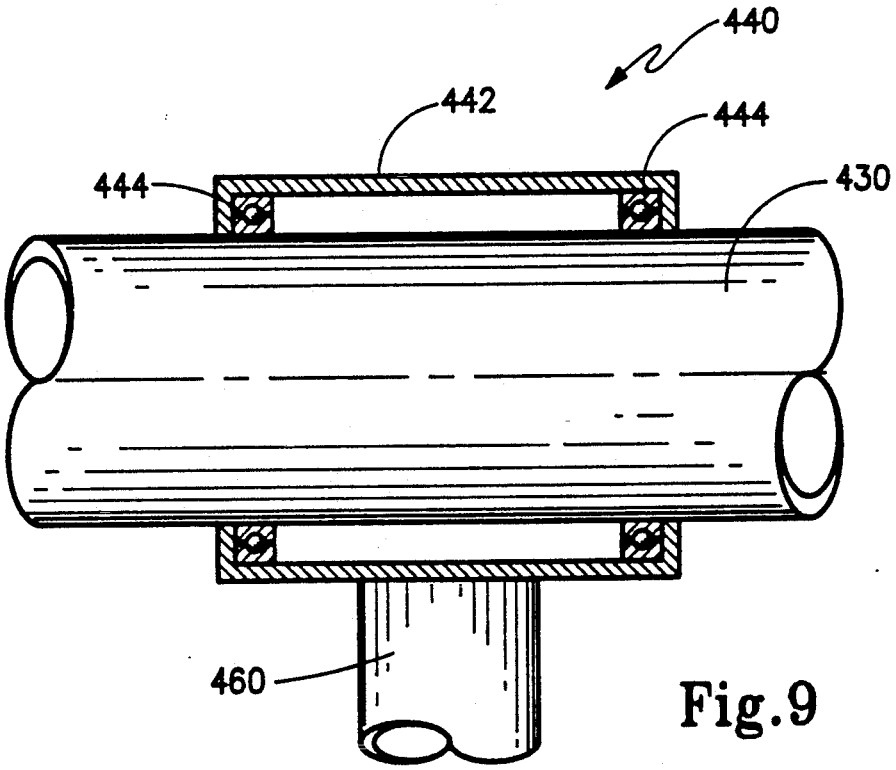
FIG. 9 is a side view and cross section showing a bracket portion of the carriage assembly shown in FIG. 8.

Finally, it should also be appreciated that the wheels of the carriage assembly may actually be affixed with respect to the axle member and rotate therewith. It is only important that the wheels be able to rotate relative to the bracket elements. Thus, as is shown in FIGS. 8 and 9, a fifth alternative embodiment shows a carriage assembly 410 that includes a pair of wheels 452 that are rigidly affixed to an axle member 430 that is a tubular member of circular cross-section. A pair of bracket elements 440 slideably receive axle member 430. As is best shown in FIG. 9, each bracket member 440 is in the form of a tubular sleeve 442 which mounts a pair of bearings 444 at each end thereof. Thus, axle member 430 may rotate with respect to bracket 442. Support members 460 then depend downwardly from a respective bracket 440 and include pairs of aligned holes for openings 466 similar to openings 66 described with respect to carriage assembly 10. Here, however, a spacing bar 470 extends between support members 460 and is formed of a pair of cooperative, complimentary telescoping spacing bar sections of 472 and 474 which allow the distance "w" between support members 460 to be adjusted. Retaining pin 476 is then received through complimentary holes (not shown) to lock spacing bar 470 the desired extension. In order to prevent drifting of bracket elements 440 on central axle 430, a pair of retaining collars 480 may be provided on axle member 430 and releasably remain in position by means of thumb screws 482. It should be understood, of course, that spacing bar 470 may be eliminated, in which case the set width of the trench shield supported by carriage assembly 410 would prevent support member 460 from moving together.

Accordingly, the present invention has been described with some degree of particularity directed to the preferred embodiment of the present invention. It should be appreciated, though, that the present invention is defined by the following claims construed in light of the prior art so that modifications or changes may be made to the exemplary embodiments of the present invention without departing from the inventive concepts contained herein. For example, the structure of the support members and the elements to interconnect the support members to a trench shield may depend upon the construction of the trench shield with which the present invention is to be employed.

I claim:

1. A carriage assembly operative to support a trench shield in a suspended relationship in a trench excavated in the ground, comprising:

(a) an axle member;

(b) a pair of spaced apart bracket elements disposed on said axle member and each adapted to support a portion of said trench shield;

(c) a pair of wheel assemblies disposed at opposite ends of said axle member, each said wheel assembly including a wheel rotatably mounted with respect to said bracket elements, said wheels operative to engage a surface of the ground laterally adjacent to said trench; and (d) a support member attached to each of said bracket elements in downwardly depending relation therefrom when said wheels engage the surface of the ground, said support member operative to interconnect to said trench shield whereby said trench shield may be fastened to said support member and thereby suspended from said axle member and whereby said trench shield may be advanced along said trench by said wheels.

2. A carriage assembly according to claim 1 wherein each of said bracket elements is slideably disposed on said axle member.

3. A carriage assembly according to claim 2 including a locking element associated with each said bracket element and operative to releasably secure said bracket element at a selected location along said axle member.

4. A carriage assembly according to claim 1 wherein said wheels are affixed to said axle member, each of said bracket elements including at least one bearing for rotatably receiving said axle member whereby said axle member may relatively rotate with respect to said bracket member.

5. A carriage assembly according to claim 4 wherein each of said bracket elements is slideably disposed on said axle member and including a locking element associated with each said bracket element, said locking elements operative to releasably secure said bracket elements at selected locations along said axle member.

6. A carriage assembly according to claim 4 including a spacing bar extending between said support members in parallel relation to said axle member.

7. A carriage assembly according to claim 6 wherein said spacing bar has a pair of complimentary telescoping spacing bar sections whereby said spacing bar has an adjustable effective length.

8. A carriage assembly according to claim 7 including a spacing bar locking element operative to selectively retain said complimentary telescoping spacing bar sections at a selected effective length.

9. A carriage assembly according to claim 1 wherein each of said wheel assemblies includes a mounting member adjustably interconnecting a respective said wheel to said axle member whereby said wheels may be adjustably spaced apart from one another.

10. A carriage assembly according to claim 9 wherein said axle member includes a tubular central axle section having opposite open ends operative to telescopically receive said mounting members whereby said axle member has an adjustable effective axle width.

11. A carriage assembly according to claim 10 including axle locking elements operative to retain said mounting members at a selected effective axle width.

12. A carriage assembly according to claim 10 wherein said bracket elements are disposed on said central axle section.

13. A carriage assembly according to claim 1 wherein said axle member has an axle width between said wheels, said axle width being selectively adjustable.

14. A carriage assembly according to claim 1 wherein each said support member is formed by a tubular piece adapted to be telescopically received in a complimentary tubular section of said trench shield.

15. A carriage assembly according to claim 14 wherein said tubular piece has a plurality of pairs of opposed holes formed therein for alignment with complimentary holes formed in said tubular sections and including a retaining pin operative to be received through said complimentary holes and an aligned pair of said holes in a respective said tubular piece.

16. A carriage assembly according to claim 1 wherein each said support member is formed by a channel piece adapted to mount to said trench shield.

17. A carriage assembly according to claim 16 wherein each said channel piece has a plurality of slots formed therein.

18. A carriage assembly according to claim 1 wherein each said bracket element is a sleeve sized and configured to receive said axle member whereby said bracket elements are slideable therealong.

19. A carriage assembly according to claim 1 wherein said axle member is formed as an elongated tubular piece of square-shaped cross-section.

20. Apparatus adapted to support opposite ends of a trench shield while said trench shield is positioned in a trench excavated in the ground wherein said trench shield includes a pair of opposed protective panels operative to face against sidewalls of said trench in spaced-apart relation to one another and spreader beams for retaining said panels in spaced apart relation to one another, said apparatus operative to permit suspended transport of said trench shield in the trench and comprising a pair of wheeled support assemblies adapted to mount to the opposite ends of said trench shield and to suspend said trench shield in the trench, each said support assemblies including an axle member, a pair of spaced apart bracket elements disposed on said axle member and each adapted to support a protective pan, a pair of wheel assemblies disposed at opposite ends of said axle member, each said wheel assembly including a wheel rotatably mounted with respect to said bracket elements and operative to engage a surface of the ground laterally adjacent to said trench, and a support member attached to each of said bracket elements in downwardly depending relation therefrom when said wheels engage the surface of the ground, said support member including means for interconnection to said trench shield whereby said trench shield may be fastened to said support member and thereby suspended from said axle member and whereby said trench shield may be advanced along said trench by said wheels.

21. Apparatus according to claim 20 wherein said axle member is tubular in construction, said bracket elements constructed as sleeves sized and configured to telescopically receive said axle member.

22. Apparatus according to claim 21 including a mounting member telescopically received in each end of said axle member to adjustably project outwardly therefrom and connect a respective one of said wheel assemblies to said axle member, and including axle locking elements operative to retain each said mounting members at a selected position relative to said axle member.

* * * * *